United States Patent [19]

MacDonald

[11] Patent Number: 4,511,017

[45] Date of Patent: Apr. 16, 1985

[54] ELEVATOR SYSTEM

[75] Inventor: Robert C. MacDonald, West Caldwell, N.J.

[73] Assignee: Westinghouse Electric Corp., Pittsburgh, Pa.

[21] Appl. No.: 534,005

[22] Filed: Sep. 20, 1983

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 2,795,296 | 6/1957 | Suozzo | 187/29 |
| 4,037,688 | 7/1977 | Winkler | 187/29 |
| 4,046,227 | 9/1977 | Kirsch et al. | 187/29 |
| 4,046,228 | 9/1977 | Powell | 187/29 |
| 4,162,719 | 7/1979 | Husson et al. | 187/29 |
| 4,379,499 | 4/1983 | Nowak | 187/29 |
| 4,463,834 | 8/1984 | Polis et al. | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system, and method of operating same, in which emergency back-up service is provided all floors of a building when normal service is degraded, such as due to a dispatcher malfunction, a communication failure between the elevator cars of a bank of cars and a group supervisory controller or dispatcher, failure of the hall call circuits, and the like. When the emergency service is provided, a different initial block of floors is assigned to each elevator car, and as each elevator car completes a round trip its block of assignments are revised in a rotational manner. Thus, all floors are guaranteed service as long as at least one elevator car is operational.

21 Claims, 9 Drawing Figures

ELEVATOR SYSTEM

BACKGROUND OF THE INVENTION

1. Field of the Invention

The invention relates in general to elevator systems, and more specifically to methods and apparatus for providing emergency back-up service for a building when the primary elevator service malfunctions.

2. Description of the Prior Art

Certain types of malfunctions can occur in an elevator system which results in failure of the elevator cars to respond to hall calls, i.e., calls for elevator service placed in the hallways of the floors of a building. For example, the power supply associated with the hall circuits can fail, the group supervisory control or dispatcher which assigns hall calls to the elevator cars can malfunction, or the communication link between the dispatcher and elevator cars can fail. A prior art arrangement for providing emergency back-up service is called "block" operation. The criteria for block operation is to: (a) serve all floors of the building, (b) in the shortest possible time, while (c) making as few stops as possible. Item (c) prevents shortening the motor life due to overheating, and it avoids tripping of the motor overloads which take the elevator car out of service. In the prior art mode of block operation, each car is assigned a predetermined different group of floors, and each car stops at the floors of its group. If a car is out of service, or it goes out of service, its assigned floors would only be served when a car call in an operational car selects one of these floors, resulting in practically no service for these floors. Some prior art systems, as a defense against all cars not being in service, assign more than one elevator car to each floor. This practice, however, significantly increases the time to serve each call, degrading item (b) above, and it increases the number of stops for each elevator car per round trip, degrading item (c).

SUMMARY OF THE INVENTION

Briefly, the present invention relates to new and improved apparatus and methods for providing emergency back-up service for an elevator system having a bank of elevator cars, which satisfies all three criteria for block operation.

The new and improved methods include preassigning a predetermined different pattern of floors to each elevator car of the bank, and revising each car's assignment in response to a predetermined occurrence. A predetermined occurrence, for example, may be the completion, by an elevator car, of its present group of assignments. This may be determined by detecting when a car has completed a round trip from a predetermined floor, such as from the main or lobby floor.

The new and improved apparatus includes a read-only memory (ROM) for each elevator car having the initial block operation assignments stored therein in the form of memory words. The bits of each memory word correspond to different floors of the building, and set bits indicate assignments. Each memory word is revised in a rotational manner, in response to the detection of the predetermined occurrence, such as by shifting each set bit one bit position to the left, while always retaining a main floor assignment for each elevator car. The assignments wrap around, i.e., end-around carry, to the LSB (least significant bit) of a memory word when a set MSB (most significant bit) is incremented.

BRIEF DESCRIPTION OF THE DRAWINGS

The invention may be better understood, and further advantages and uses thereof more readily apparent, when considered in view of the following detailed description of exemplary embodiments, taken with the accompanyings in which.

DESCRIPTION OF PREFERRED EMBODIMENTS

Figure 1:
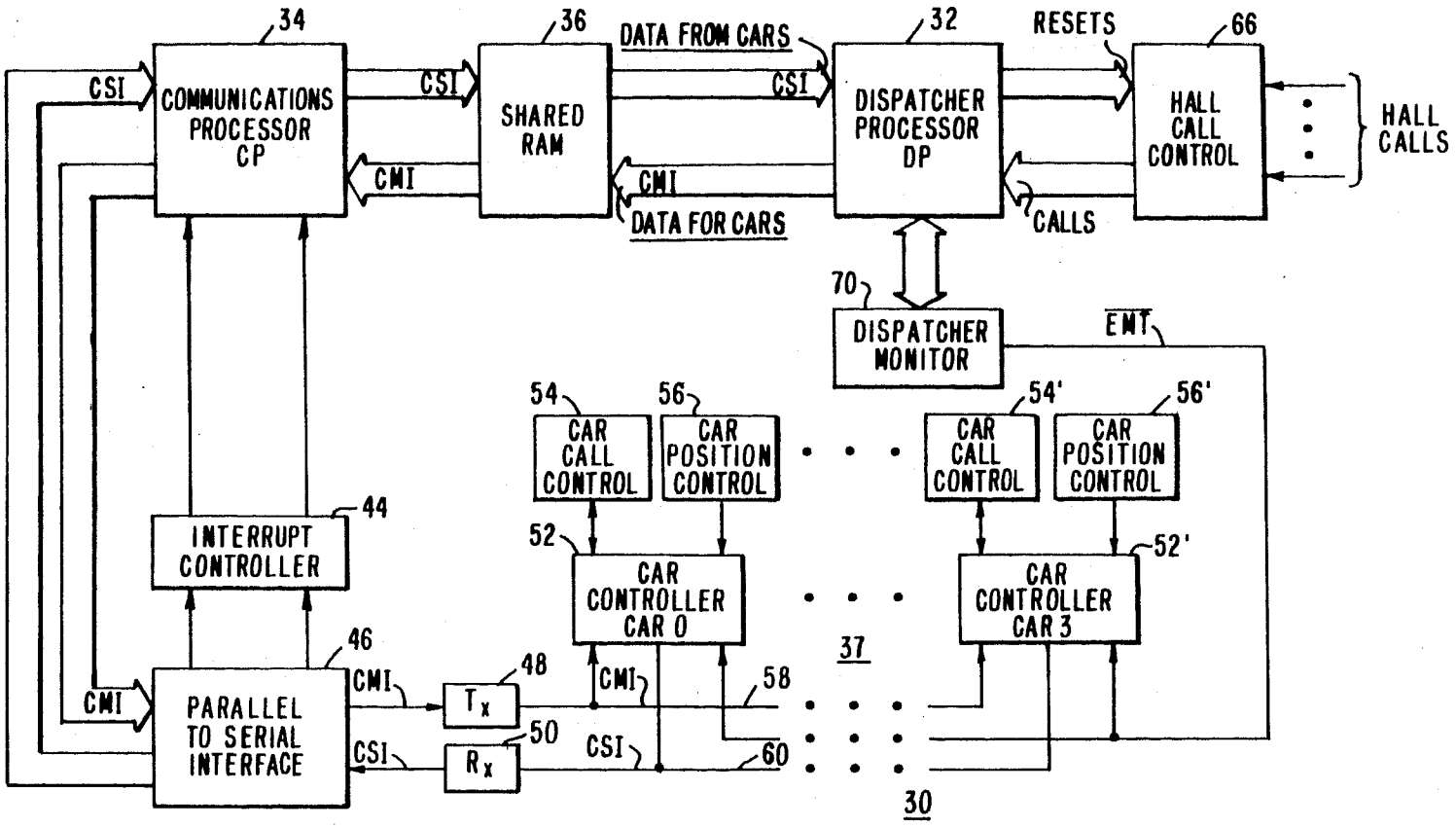
FIG. 1 is a block diagram of an exemplary elevator bank which may utilize the teachings of the invention.

Referring now to the drawings, and to FIG. 1 in particular, there is shown an elevator system 30 having a bank 37 of elevator cars, such as four cars referred to as car 0, car 1, car 2 and car 3. The bank 37 of elevator cars are under the supervisory control of a dispatcher processor (DP) 32. A communications processor (CP) 34, operating with a random access memory (RAM) 36 shared with DP 32, handles the communications between the elevator cars and DP 32. The car controllers of the various elevator cars, such as car controller 52 of car 0, prepare car status information (CSI), including information relative to its car calls and its car position, represented by functions 54 and 56, respectively, and the car controllers send this information to CP 34 via serial data link 60. This information is stored in a receive buffer 50 of an interface 46. Interface 46 communicates the fact that it has CSI for CP 34 via an interrupt generated by an interrupt controller 44, and interface 46 places the information on a parallel data bus when CP 34 indicates it is ready to receive it.

DP 32, in response to (a) CSI, (b) hall calls provided by hall call control 66, and (c) its own built-in strategy, prepares assignments or car mode information (CMI) for each of the elevator cars. When a transmit buffer 48 of interface 46 is empty and ready to transmit information, the interrupt controller 44 provides an interrupt signal for CP 34. CP 34 places the CMI on the parallel bus, and it is sent to the elevator cars via serial data link 58. The communication system shown in FIG. 1 is described in detail in co-pending application Ser. No. 447,059, filed Dec. 6, 1982, entitled "Elevator System", which is assigned to the same assignee as the present application. This application is hereby incorporated into the specification of the present application by reference.

If there is a malfunction of any of the functions in the chain from the hall call control 66, DP 32, RAM 36, CP 34, interface 46, interrupt controller 44, buffers 48 and 50, or data links 58 and 60, hall calls may not be properly served. Such a malfunction may be detected by a monitor 70. The present invention may use any suitable monitor or means for detecting the need for initiating an emergency back-up mode, such as the arrangements disclosed in U.S. Pat. No. 4,162,719 and in co-pending application Ser. No. 286,146, filed July 23, 1981, entitled "Elevator System", which are assigned to the same assignee as the present application. Accordingly, U.S. Pat. No. 4,162,719 and application Ser. No. 286,146 are hereby incorporated into the present application by reference. It is sufficient for purposes of the present application to note that when a need for emergency back-up service is detected, monitor 70 provides a true signal $\overline{EMT}$, i.e., a signal $\overline{EMT}$ which is at the logic 0 level. Signal $\overline{EMT}$ may be hard wired to the car controllers of all of the elevator cars in the bank 37.

Figure 2:
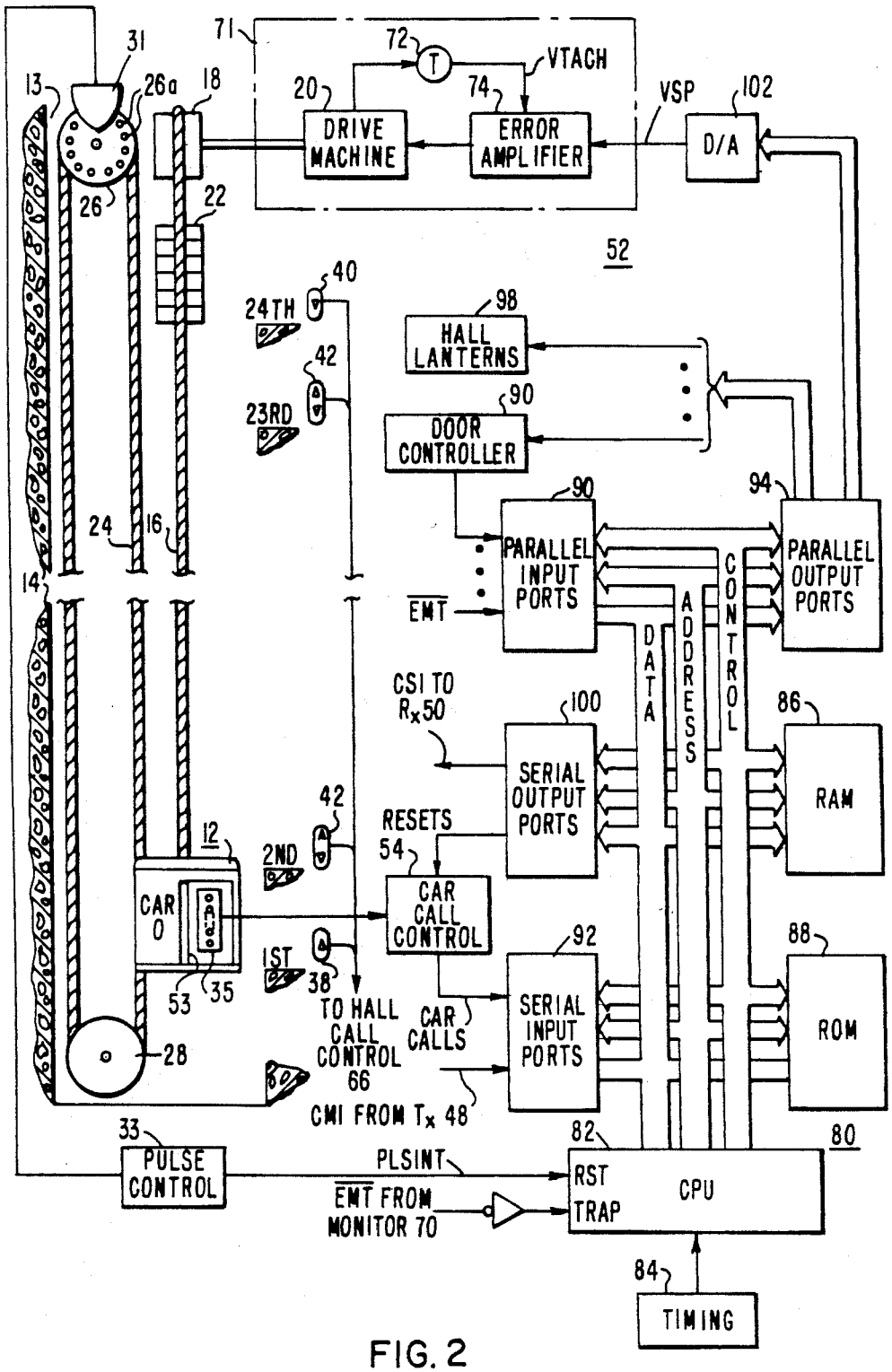
FIG. 2 is a detailed diagram of one of the elevator cars and its associated car controller, shown in block form in FIG. 1.

FIG. 2 is a schematic diagram of elevator car 0 and its associated car controller 52. The remaining elevator cars and their car controllers of bank 37 would be of similar construction. Car 0, which includes a cab 12, is mounted in a hatchway 13 for movement relative to a structure 14 having a plurality of landings, such as 24, for example. Car 0 is supported by a plurality of wire ropes 16 which are reeved over a traction sheave 18 mounted on the shaft of a drive machine 20. The drive machine 20, along with its associated closed loop feedback control, is referred to generally as drive machine control or motor control 71. Motor control 71 includes a tachometer 72 for providing a signal VTACH responsive to the actual speed of the elevator car and an error amplifier 74. U.S. Pat. No. 4,277,825, which is assigned to the same assignee as the present application, discloses suitable motor control, and it is hereby incorporated into the present application by reference.

A counterweight 22 is connected to the other ends of the ropes 16. A governor rope 24 which is connected to the car 12, is reeved over a governor sheave 26 located above the highest point of travel of the car 12 in the hatchway 13, and it is directed under a pulley 28 located at the bottom of the hatchway. A pickup 31 is disposed to detect movement of the elevator car 0 through the effect of circumferentially-spaced openings **26*a* in the governor sheave 26, or in a separate pulse wheel which is rotated in response to the rotation of the governor sheave. The openings 26*a* are spaced to provide a pulse for each standard increment of travel of the elevator car 12, such as a pulse for each 0.25 inch of car travel. Pickup 31 may be of any suitable type, such as optical or magnetic. Pickup 31 is connected to pulse control 33 which provides distance pulses PLSINT for the car controller 52**.

Car calls, as registered by pushbutton array 35 mounted in the car 0, are processed by car call control 54, and the resulting information is directed to the car controller 52.

Hall calls, as registered by pushbuttons in the hallways, such as an up pushbutton 38 located at the first floor, a down pushbutton 40 located at the 24th floor, and up and down pushbuttons 42 located at each of the intermediate floors, are processed in hall call control 66. The resulting processed hall call information is directed to DP 32.

Car controller 52 tabulates the distance pulses PLSINT from the pulse control 33 in a suitable up/-down counter to develop a count POS16 (shown in FIG. 6) concerning the precise position of car 0 in the hatchway 13, to the resolution of the standard increment. The POS16 count when the car 0 is level with each floor of the building 14 is used as the "address" for the associated floor. A speed pattern generator function of car controller 52 also uses the POS16 count. A suitable speed pattern generator which may be used is disclosed in copending application Ser. No. 446,149, filed Dec. 2, 1982, entitled "Speed Pattern Generator for an Elevator Car", which is assigned to the same assignee as the present application.

A floor selector function of car controller 52, in addition to keeping track of the position of the car 0, also tabulates the calls for service for the car, and it provides signals for starting the elevator car on a run to serve calls for elevator service. The floor selector function also develops an advanced floor position for the elevator car 0, referred to as the AVP floor. The advanced floor position AVP is the closest floor ahead of the elevator car 0 in its travel direction at which the car can stop according to a predetermined deceleration schedule. The floor at which the car 12 should stop, to serve a car call or a hall call, or simply to park, is referred to as the target floor. When the AVP of the car 0 reaches the target floor, the floor selector may provide an appropriate signal for use by the speed pattern generator function. Alternatively, the floor selector function may provide a binary word TARGET, which is the address of the target floor, and the speed pattern generator function can prepare and maintain a binary word AVP16, which is the advanced car position in terms of the standard increment. The speed pattern generator can thus compare TARGET and AVP16 to determine when to initiate the slowdown phase of the run. The floor selector function also controls the resetting of the car calls when they have been serviced. U.S. Pat. No. 3,750,850, which is assigned to the same assignee as the present application, sets forth suitable apparatus for the floor selector function of car controller 52. All of the functions of the car controller 52 may be implemented by a single microcomputer 80, which simplifies the communication between the floor selector and speed pattern generator functions, or certain of the functions may be implemented by microcomputer 80 and others by separate microcomputers, or other suitable means. A priority executive program associated with microcomputer 80 runs those function programs which have been placed into bid, such as described in the hereinbefore mentioned co-pending application Ser. No. 446,149, as well as in U.S. Pat. No. 4,240,527, which is assigned to the same assignee as the present application.

Microcomputer 80 includes a central processing unit (CPU) 82, system timing 84, a random access memory (RAM) 86, a read-only, i.e., non-volatile, memory (ROM) 88, parallel input ports 90 for receiving signals from external car related functions, serial input ports 92, such as for receiving CMI from $T_x$48 and also car calls if the car calls are serialized, parallel output ports 94 to which a digital speed pattern signal may be sent, as well as signals for a door controller 96 and hall lanterns 98, and serial output ports 100. The serial output ports 100 may be used, for example, for sending CSI to $R_x$50 and car call resets, if they are serialized. A digital-to-analog (D/A) converter 102 provides an analog speed pattern signal VSP for comparison with the signal VTACH from tachometer 72. Microcomputer 80, for example, may be INTEL's iSBC80/24 TM single board computer. With this computer, the CPU 82 would be INTEL's 8085A microprocessor, the timing function 84 would be INTEL's clock 8224, and the input and output ports may be on-board ports.

According to the teachings of the invention, the initial floor assignments for each of the elevator cars for use during the emergency back-up mode initiated by a true signal $\overline{EMT}$, are prepared and stored in the ROM of the car's car controller, such as ROM 88 for car 0. A suitable format for such floor assignments is set forth in FIG. 3. Three 8-bit memory words, referenced word 0, word 1 and word 2, may be used for a building having 24 floors, for example, with bits 0 through 7 or word 0 corresponding to floors 1–8, respectively, bits 0 through 7 of word 1 corresponding to floors 9 through 16, respectively, and bits 0 through 7 of word 2 corresponding to floors 17 through 24, respectively. A set bit, i.e., a logic 1 in a bit position, indicates the associated floor number is assigned to the associated elevator car.

Figure 4:
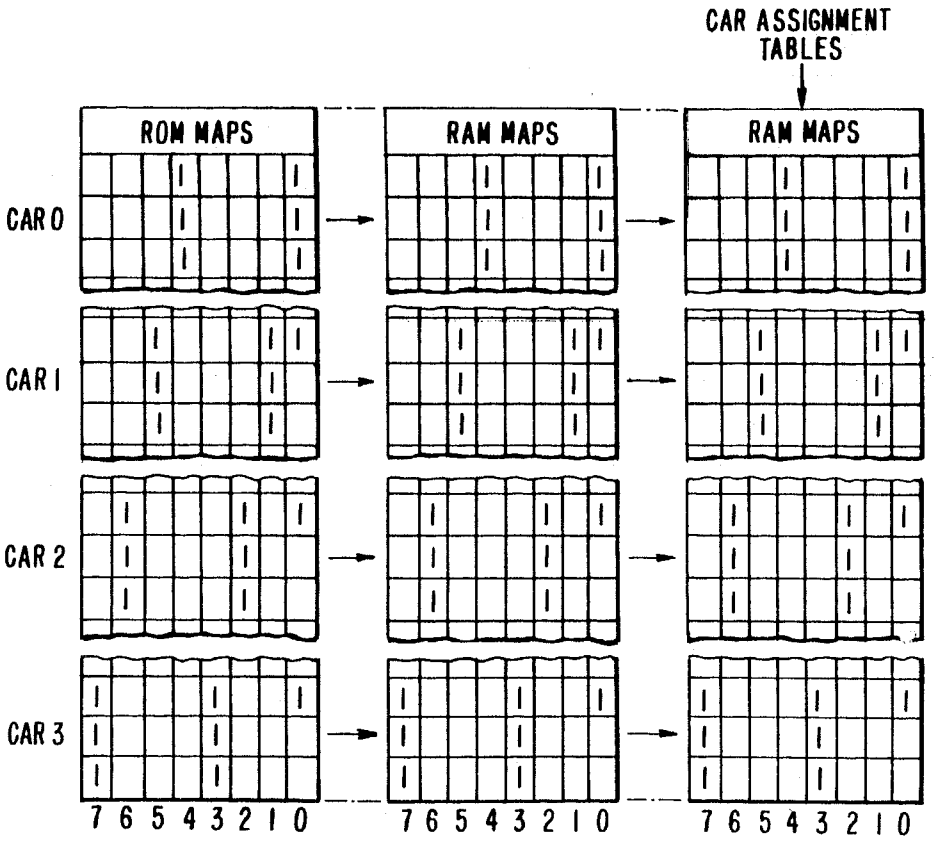
FIG. 4 is a memory map, illustrating different patterns of initial floor assignments for the various elevator cars, using the format of FIG. 3, and also illustrating how the floor assignments may be transferred to the assignment tables of the elevator cars.
Figure 3:
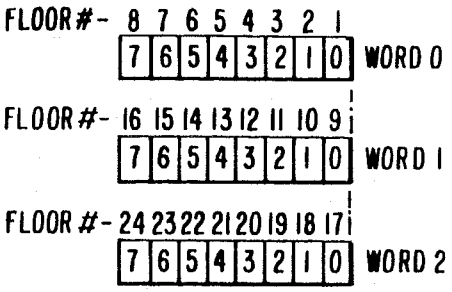
FIG. 3 illustrates a format for memory words which may be used to indicate floor assignments for the elevator cars.

FIG. 4 illustrates a ROM map having suitable initial or pre-assignment of floor for the elevator cars, using the format of FIG. 3. Each floor is assigned to at least one elevator car, and in addition, the main or lobby floor is assigned to all of the cars. It will be assumed, for purposes of example, that the main or lobby floor is floor #1, but it may be any floor. At least one floor from each memory word is assigned to each elevator car, and in the example of four cars and 24 floors, at least two floors are assigned to each car from each memory word. The floors assigned to a car of each word are separated by the maximum number of floors which enables similar spacings between the assigned floors for all cars. For example, if car 0 is assigned the floors associated with bit position 0 of each memory word, it would also be assigned the floors associated with bit position 4 of each memory word. Car 1 would then be assigned to the floors associated with bit position 1 in each of the three memory words, and also the floors associated with bit position 5. In like manner, car 2 would be assigned the floors associated with bit positions 2 and 6, and car 3 would be assigned the floors associated with bit positions 3 and 7. As hereinbefore stated, all cars are also assigned the main or lobby floor, which is bit position 0 of word 0, in the previous example.

Figure 6:
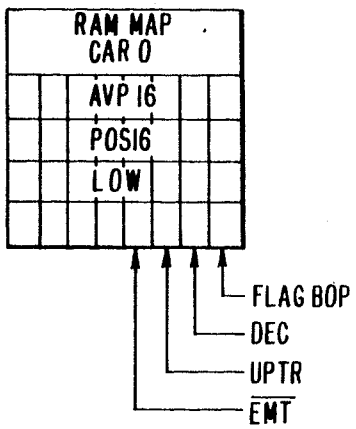
FIG. 6 is a RAM map setting forth certain of the signals and flags ulilized by the program shown in FIG. 5.
Figure 5:
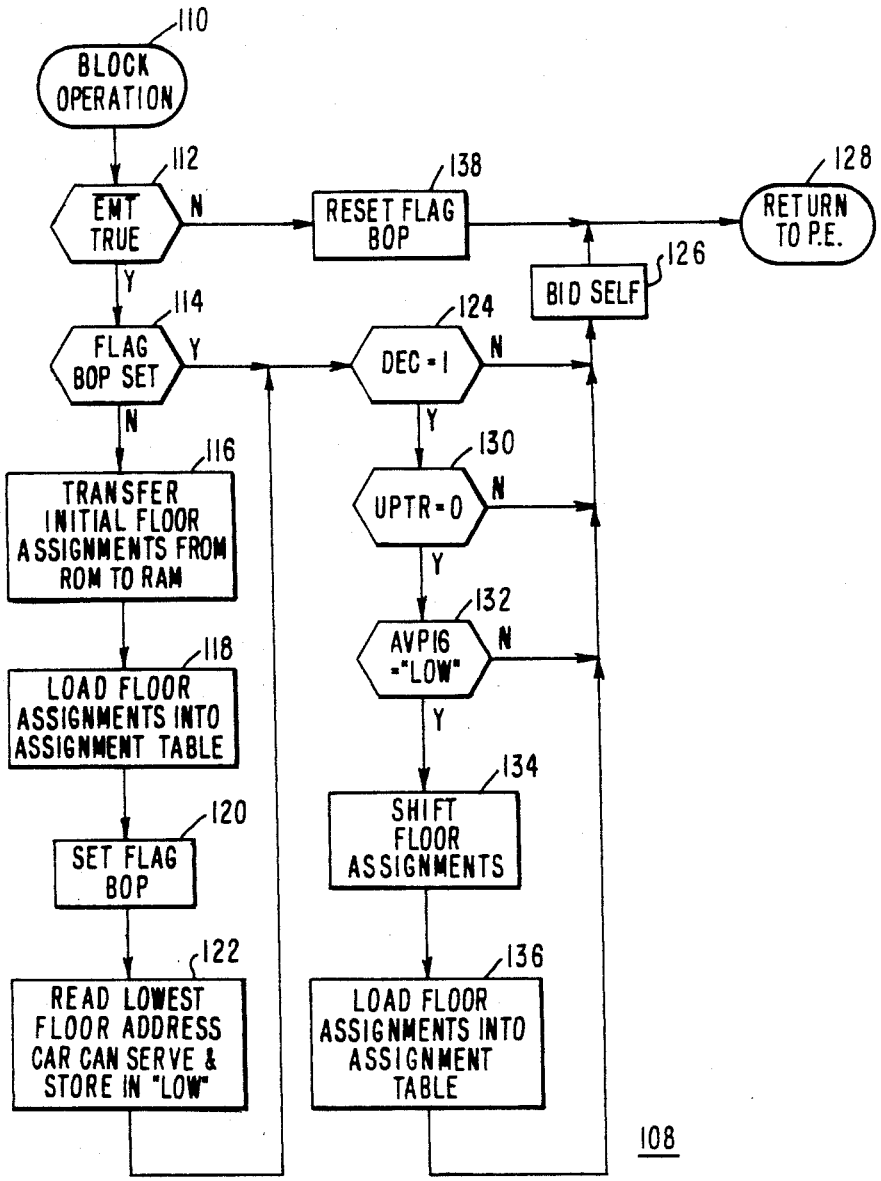
FIG. 5 is a detailed flow chart of an operating program which may be used to implement the teachings of the invention.

A flow chart for a suitable program 108 which implements the teachings of the invention is set forth in FIG. 5. This flow chart is stored in ROM 88 shown in FIG. 2, and also in similar ROM's associated with each of the remaining elevator cars. The program 108 may be set up to monitor an input port, such as port 90, for detecting a true signal $\overline{EMT}$, in which event program 108 would periodically run and exit immediately if it finds that signal $\overline{EMT}$ is not true. Alternatively, signal $\overline{EMT}$ may be wired to an interrupt of CPU 82, such as to the TRAP interrupt of INTEL's 8085, if this interrupt is not used to sense a power failure. If so, it may be wired to any of its three RST interrupts. For purposes of example, it will be assumed that signal $\overline{EMT}$ triggers an interrupt. When CPU 82 receives an interrupt, it is vectored to a predetermined interrupt service subroutine, associated with the particular interrupt, with the interrupt service subroutine being indicated generally at 110. Step 112 then checks to see if signal $\overline{EMT}$ is true. This is done in order to prevent program 108 from bidding itself when the conditions which cause the true $\overline{EMT}$ signal have been corrected. Step 112 then checks one of the parallel input ports, or the interrupt, in order to determine if $\overline{EMT}$ is true. At this point, since the interrupt just occurred, $\overline{EMT}$ will be true and step 112 proceeds to step 114 to check a flag BOP. Flag BOP is used to determine if the initial or pre-assignments shown in the ROM map of FIG. 4 for the elevator car have been obtained from ROM 88. FIG. 6 is a RAM map of RAM 86, illustrating where flag BOP may be located. Since the interrupt just occurred, flag BOP will not be set, and step 114 proceeds to step 116 which reads the initial floor assignments for car 0 in ROM 88, and it stores this information in RAM 86, such as shown in the intermediate memory map of FIG. 4. Step 118 loads the assignment into a predetermined location in RAM 86, such as a register called the car assignment table. Car controller 52 uses the car assignment table to identify which floors it should stop at. Depending upon the type of building and its traffic patterns, the assignments in the car assignment table for block operation may be treated as both up and down calls from the intermediate floors, stopping at the assigned floors during up travel and also during down travel. Alternatively, the assignments may be treated as only down calls. In the latter instance, the car would leave the main floor and stop only for car calls while traveling in the upward direction. The car would then proceed to the highest assigned floor and reverse, stopping at all of the assigned floors while traveling downwardly.

Figure 7:
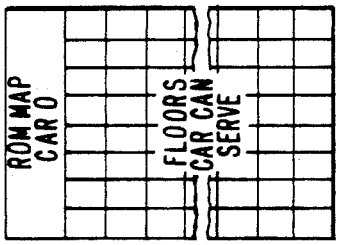
FIG. 7 is a ROM map for an elevator car which sets forth the floors of the building the car is enabled to serve.

After step 118 loads the floor assignments into the car assignment table, step 120 sets flag BOP shown in the RAM map of FIG. 6. Step 122 reads the lowest floor address that the elevator car can serve, which may be stored in ROM 88, as shown in the ROM map in FIG. 7, and it stores this information in RAM 86 at a location LOW, as shown in FIG. 6. The address stored at location LOW may or may not be the address of the main or lobby floor. The floor address stored in location LOW is used to determine when the elevator car has completed a round trip, starting at and returning to the lowest floor it can serve.

When an elevator car is making a run and its advanced position AVP16 reaches the address TARGET of a target floor, a true signal DEC may be provided by the floor selector function, or by the speed pattern generator function, of the car controller 52. A signal UPTR is provided by the floor selector function to indicate the car's travel direction, with a logic 1 indicating up travel and a logic 0 indicating down travel. These signals, stored in the RAM map shown in FIG. 6, are used to determine when the elevator car has made a round trip.

Figure 9:
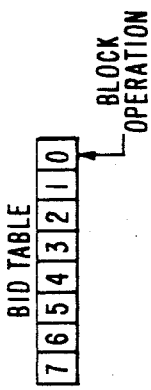
FIG. 9 illustrates a bid table which may be used by the car controller of each elevator car for running its different programs.

More specifically, step 122 proceeds to step 124 which checks to see if signal DEC is true. In this instance, at the very start of the run, it will not be true, and step 124 proceeds to step 126 which places itself in bid. A suitable bid table format, used by the priority executive program, is shown in FIG. 9. One of the bits, or a word, as desired, of the bid table, is assigned to the block operation program 108, and when it is set, the priority executive will run the program in its turn. Thus, step 126 sets bit position 0 of the bid table. The other bits are associated with other functions of the car controller 52. Step 126 exits program 108 at 128, returning control to the priority executive program.

Since program 108 has now been placed in bid, it will run when its turn comes, and step 112 will proceed to step 114 if signal $\overline{EMT}$ is still true. Step 114 will now find flag BOP set, and step 114 then proceeds to step 124 to determine if the elevator car is set to decelerate and stop at a floor. If signal DEC is set, step 130 checks UPTR to see if the car is traveling in the downward direction. If it is not, the car cannot be completing a round trip, and step 130 proceeds to step 126. If step 130 finds signal UPTR is equal to 0, it proceeds to step 132 to see if the advanced position AVP16 of the car is equal to the floor address stored at the location LOW of RAM 86. If it is not, the car is not completing a round trip, and step 132 proceeds to step 126. If step 132 finds AVP16 equal to the address stored at location LOW, the car is in the process of landing at the lowest floor in the building that it can serve, signifying that the car is completing a round trip. This event is used to revise the floor assignments for the associated elevator car. In a preferred embodiment, the assignments are modified in a rotational manner by shifting the set bits to the next adjacent significant bit position, as indicated by step 134. In other words, the location of each set bit is reset, and the next most significant bit position in each memory word is set.

The intermediate storage location shown in FIG. 4 still retains the last assignment, notwithstanding that the assignments in the assignment table have been reset as the car responds thereto, and, if this intermediate location is not already a register which enables bit manipulation, the contents of this intermediate location would be located into such a register, such as an accumulator, for preparing the revised assignments. The new or revised assignments would be stored in both the intermediate location, and in the car assignment table, as indicated by step 136. Step 136 proceeds to step 126 and to the exit 128. The car would then proceed to serve the newly assigned floors on its next round trip through the building.

Figure 8:
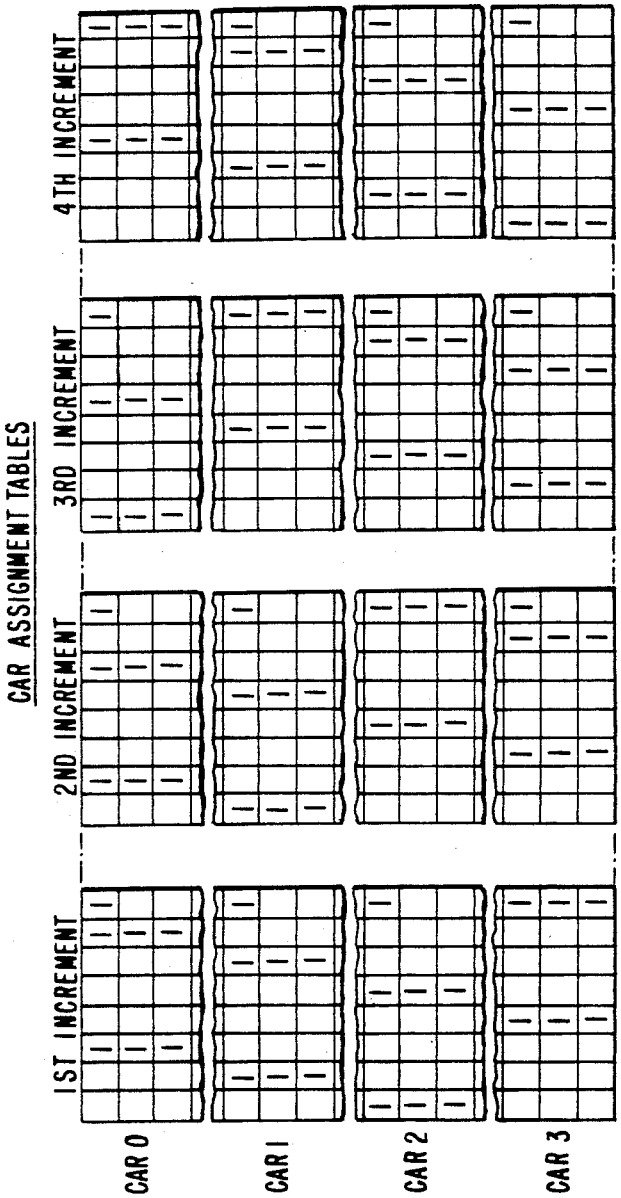
FIG. 8 illustrates successive incrementations of each car's assignment table.

FIG. 8 illustrates that in the present example, four such assignment revisions will return the assignments back to the initial assignments, and this procedure continues until step 112 finds signal $\overline{EMT}$ is no longer true. Step 112 then proceeds to step 138 which resets flag BOP, and step 138 proceeds directly to exit 128, without placing itself in bid.

As shown in FIG. 8, when the MSB's of the three memory words are set, the next shifting step wraps around each memory word, resulting in the LSB's of each memory word being set. Since the MSB's of car 3 are initially set, the first revision sets bit positions 0 of the three memory words. As hereinbefore stated, the set bit associated with the main floor is not reset. If three bits of the three memory words are set in a common bit position, and this just happens to include the main floor, the three set bits are shifted to the left, to the next bit position, while retaining a set bit at the main floor position.

In summary, there has been disclosed new and improved methods and apparatus for providing emergency back-up service when the primary elevator service is degraded for some reason. The emergency back-up service functions such that each car, after a predetermined number of round trips, will have stopped at all of the floors of the building, according to a predetermined shifting pattern, thus providing the best possible service for the building for the number of elevator cars which are in service.

I claim as my invention:

1. A method of providing emergency elevator service for each floor of a building having a bank of elevator cars and a plurality of floors, including a main floor, comprising the steps of:

pre-assigning a predetermined different pattern of floors to each elevator car of the bank, and revising the assignment for each car after a predetermined occurrence.

2. The method of claim 1 wherein the revising step revises the assignments in a rotational manner, changing each floor of its pattern by one.

3. The method of claim 1 wherein the step of pre-assigning predetermined different patterns of floors includes the step of assigning the main floor in each pattern, and wherein the step of revising the assignments for each car includes the step of retaining the main floor assignment in the revised assignment.

4. The method of claim 1 wherein the predetermined occurrence which results in the revising step changing a car's assignments, is the completion of a round trip by the car, starting from a predetermined floor and returning to the predetermined floor.

5. The method of claim 1 wherein the predetermined occurrence which results in the revising step changing a car's assignments, is the completion of a round trip by a car, starting from the main floor and returning to the main floor.

6. The method of claim 1 wherein the predetermined occurrence which results in the revising step changing a car's assignments, is the completion of a round trip by a car, starting from the lowest floor the car can serve and returning to this floor.

7. The method of claim 1 wherein the step of pre-assigning predetermined different patterns of floors to each car includes the step of including the main floor in each pattern, and the revising step revises the assignments in a rotational manner, changing each floor of each predetermined pattern by one, and including the step of retaining the main floor assignment in each revision.

8. The method of claim 1 wherein the preassigning step includes the step of spacing the floors in each pattern according to the number of cars in the bank.

9. The method of claim 8 wherein the revising step revises the assignments in a rotational manner, changing each previously assigned floor of a predetermined pattern by one, and including the step of wrapping around from one end of a pattern grouping to the other, when an end is reached.

10. The method of claim 1 wherein the preassigning step includes the step of grouping the floors into a predetermined number of groups of contiguous floors, and the step of assigning each car to at least one floor from each group.

11. The method of claim 10 wherein the revising step includes the step of revising the assignments in a rotational manner, changing each pre-assigned floor of each group by one, and including the step of wrapping around to the other end of the same group when an end of the group is reached.

12. An elevator system comprising:

a building having a plurality of floors including a main floor, a bank of elevator cars mounted in said building to serve the floors therein, means responsive to a predetermined condition for initiating an emergency operating mode of the elevator system, and means for implementing said emergency operating mode, including means for assigning a predetermined different pattern of floors to each elevator car, means for detecting a predetermined occurrence relative to each elevator car, and means responsive to each such detection for revising the associated car's pattern of floor assignments.

13. The elevator system of claim 12 wherein the means for revising each car's floor assignments does so in a rotational manner, changing each floor of this pattern by one.

14. The elevator system of claim 12 wherein the means which assigns a predetermined different pattern of floors to each car, spaces the floors of each pattern according to the number of elevator cars in the bank.

15. The elevator system of claim 14 wherein the means which revises each pattern of floor assignments changes each previously assigned floor of the pattern by one.

16. The elevator system of claim 12 wherein the means which assigns a predetermined different pattern of floors to each car includes means for grouping the floors into a predetermined number of groups of contiguous floors, with each car being assigned to at least one floor from each group.

17. The elevator system of claim 16 wherein the means for revising each car's assignments includes means for changing each pre-assigned floor of each group by one, and for wrapping around to the other end of the same group when an end of the group is reached.

18. The elevator system of claim 12 wherein the means for assigning a predetermined different pattern of floors to each elevator car includes non-volatile memory means associated with each car in which its initial pattern is stored.

19. The elevator system of claim 12 wherein the means which detects a predetermined occurrence for each elevator car, detects the arrival of the car at a predetermined floor.

20. The elevator system of claim 19 wherein the predetermined floor is the lowest floor of the building which the car can serve.

21. The elevator system of claim 12 wherein the means which revises a car's pattern of floor assignments includes random access memory means having a predetermined number of memory words associated with car assignments, the bits of which represent floors of the building, and with set bits representing assignments, with the assignments being revised by shifting set bits associated with the prior assignment to an adjacent bit, wrapping around in the same memory word when an end of a memory word is reached.

* * * * *